US005504481A

United States Patent [19]

Wys

[11] Patent Number: 5,504,481

[45] Date of Patent: Apr. 2, 1996

[54] FAIL-SAFE STOP LIGHT APPARATUS

[76] Inventor: Dennis N. Wys, 6567 Golfview, Garden City, Mich. 48135

[21] Appl. No.: 343,217

[22] Filed: Nov. 22, 1994

[51] Int. Cl.[6] ..... G08G 1/097

[52] U.S. Cl. ..... 340/931; 340/930; 340/815.8; 340/815; 340/815.9; 340/932.1; 40/612

[58] Field of Search ..... 340/931, 930, 340/815.62, 815.64, 815.8, 815.83, 815.84, 815.85, 815.86, 815.88, 815.89, 815.9, 815.91, 732.1

[56] References Cited

U.S. PATENT DOCUMENTS 1,326,009 12/1919 Wetter .
1,407,444 2/1920 Smith et al. .
2,525,937 10/1950 Palm .
3,863,214 1/1975 Kerr, Jr. .
4,502,711 3/1985 Muth .
4,642,605 2/1987 Karp .

*Primary Examiner*—John K. Peng
*Assistant Examiner*—Daryl Christian Pope
*Attorney, Agent, or Firm*—Gifford, Krass, Groh, Sprinkle, Patmore, Anderson & Citkowski

[57] ABSTRACT

An apparatus for covering a face of a traffic light with a warning sign as a result of a power failure to the traffic light. A first member is rotatably mounted to one side of the traffic light and a second member is rotatably mounted to the other side of the traffic light. A first electromagnet and a second electromagnet are provided for securing the first and second members in a first position away from the face of the traffic light. A first coil spring and a second coil spring are mounted respectively to the members and to the sides of the traffic light and cause the members to rotate to a second position covering the face of the traffic light upon release of the members by the electromagnets. An electric motor is also provided and is connected to a pair of linkage mechanisms to rewind the first and second members to their first position upon resumption of electrical power to the traffic light.

13 Claims, 2 Drawing Sheets

FAIL-SAFE STOP LIGHT APPARATUS

BACKGROUND OF THE INVENTION

1. Field of the Invention

The present invention relates generally to a supplemental visual display for a traffic signal and, more particularly, to an apparatus for covering a face of a traffic signal with a warning sign in response to a power failure of the traffic signal.

2. Description of the Prior Art

Supplemental visual display devices for use with a traffic signal and which are activated in response to a power failure of the traffic signal are well known in the art. U.S. Pat. No. 3,863,214, issued to Kerr, Jr., teaches a supplemental visual display for a traffic signal with a stop sign attached to the end of a signal arm. An electromagnet holds the arm in place against the side of the signal light during operation of the light. The interruption of an electrical signal from the controller to the electromagnet will cause the arm to pivot downwardly and away from the signal light.

U.S. Pat. No. 4,642,605, issued to Karp, similarly teaches a power failure warning responsive device having an arm pivotally mounted to the signal light and held in place by an electromagnet. When the power supply to the light is interrupted, the electromagnet releases the arm. An electromagnet releases the arm to pivot downwardly and away from the signal light once electrical flow has been interrupted to the traffic light. A collapsible warning sign unfolds between the arm and the side of the traffic light.

The disadvantage of the above devices is that a driver's first instinct is to always focus on the traffic light when entering an intersection. Therefore, the driver may not have adequate response time when travelling at high speed to realize that the light is inoperative and to then shift his attention to the warning sign which is arranged at the side of the stop light.

SUMMARY OF THE PRESENT INVENTION

The present invention is an apparatus for covering a face of a traffic signal with a warning sign in response to a power failure to the traffic signal. A first member is provided and is hingedly mounted to one side of the traffic signal. A second member is hingedly mounted to the other side of the traffic signal. A mechanism is operably connected to the first and second members and includes an electromagnet for securing the members in a first position away from the face of the traffic signal. The electromagnet releases the members upon an interruption of current flow to the signal light and the members pivot to a second position to cover the face of the traffic signal.

BRIEF DESCRIPTION OF THE DRAWING

Reference will now be made to the attached drawing, when read in combination with the following specification, wherein like reference numerals refer to like parts throughout the several views, and in which.

DESCRIPTION OF THE PREFERRED EMBODIMENT

Figure 1:
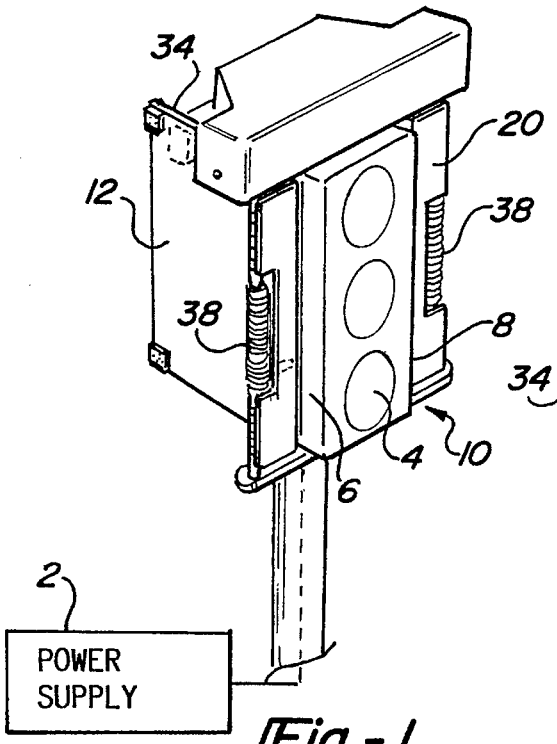
FIG. 1 is a perspective view of the apparatus of the present invention in a first position prior to the interruption of the power supply to the traffic light.
Figure 2:
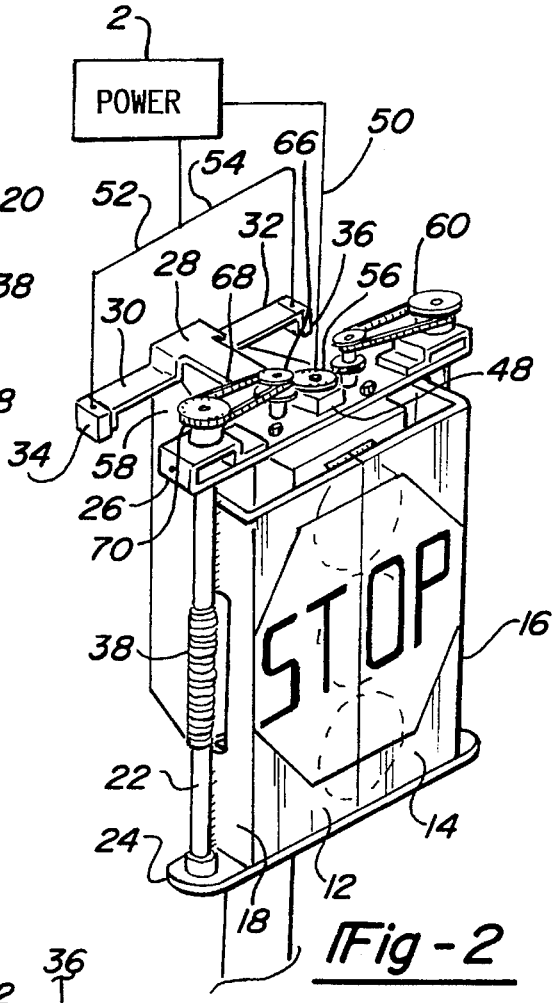
FIG. 2 is a perspective view of the apparatus of the present invention in a second actuated position after the interruption of the power supply to the traffic light.
Figure 3:
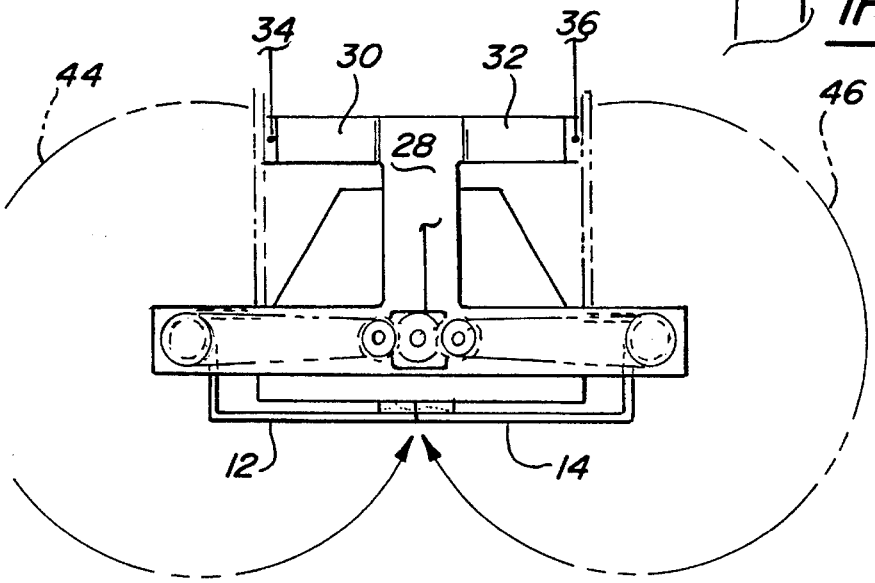
FIG. 3 is a top view of the apparatus shown in FIG. 2 and illustrating the pivoting motion of the first and second sign members.

Referring to FIGS. 1–3, an apparatus 10 for covering a face 4 of a traffic light is shown. The face 4 of the traffic light has red, yellow and green portions as is customary and also has a first side 6 and a second opposing side 8. The traffic light is of any conventional type known in the art and has a power supply 2 for supplying electrical power to the traffic light. The apparatus of the present invention is well suited to be installed on such a traffic signal which may already be in service.

The apparatus of the present invention includes a first member 12 attached to the traffic light along its first side 6 and a second member 14 attached along its second side 8. The first member 12 and the second member 14 each comprise half of a completed sign member 16, such as a stop sign, which warns oncoming drivers of the inoperative condition of the traffic light and effectively turns the intersection into a four-way stop. The side members are preferably of a metallic construction not dissimilar to the material used in the construction of the traffic light.

As can be clearly seen in FIGS. 1 and 2, the first member 12 has a portion 18 which extends perpendicularly from an edge of the first member 12 at the first side 6 of the traffic light. The second member 14 likewise has a perpendicularly extending portion 20 extending from the second member 14 along an edge thereof at the second side 8 of the traffic light. The portion 18 of the first member 12 is attached along at least a part of its length to a vertically-extending shaft 22 (see FIG. 4). The portion 18 is preferably connected by welds to the shaft 22, however other connections can be used as is known in the art.

The shaft 22 is rotatably mounted at a first end to a horizontally extending mounting plate 24 secured to an underside of the traffic light and extending beyond the sides of the traffic light. The shaft 22 is also rotatably mounted at a second end to another mounting plate 26 which is likewise secured to a top side of the traffic light. Although it is not clearly shown in FIGS. 1 and 2, the second portion 20 of the side member 14 is also connected to an identical shaft which is in turn rotatably mounted at opposite ends to the mounting plates 24 and 26.

Figure 4:
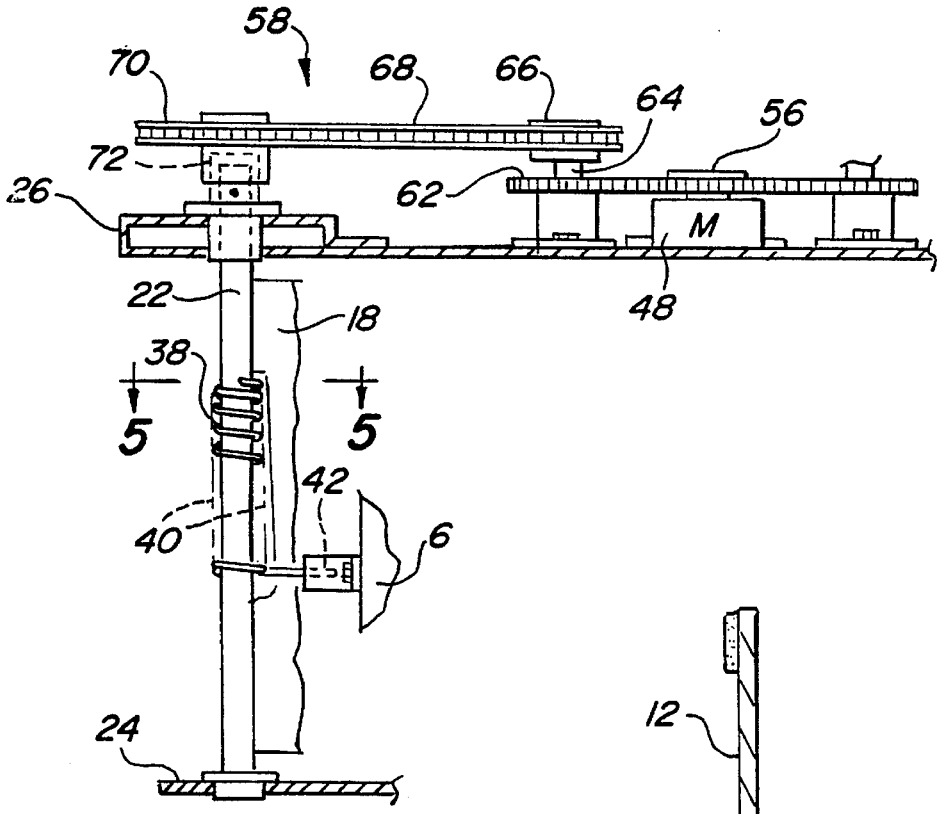
FIG. 4 is a sectional view of the apparatus shown in FIG. 2 and illustrating the gear, motor and coil spring for enabling the members to be rewound to their first position after restoration of power to the traffic light.
Figure 5:
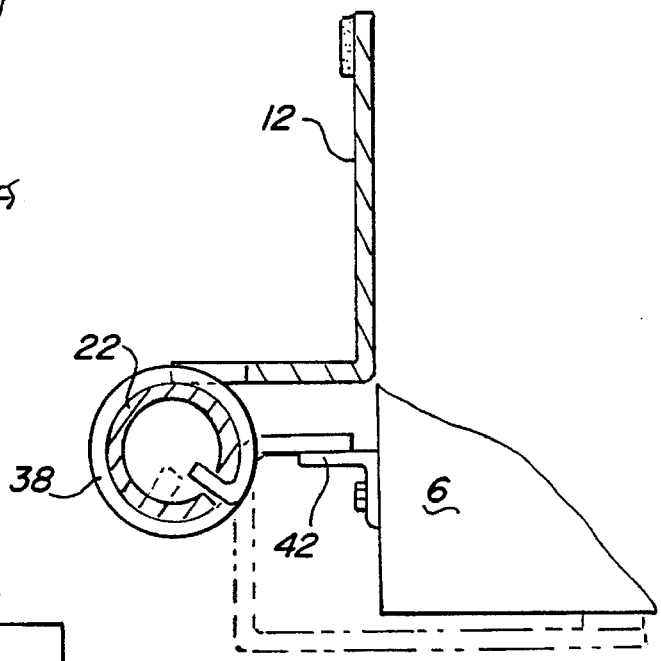
FIG. 5 is a cutaway view taken along line 5— 5 of FIG. 4 and illustrates the attachment of a coil spring to one of the sign members.

Referring again to FIGS. 2 and 3, and also to FIGS. 4 and 5, a member 28 is centrally attached to the mounting plate 26 and extends rearwardly from the traffic light. The member 28 has a first leg 30 and a second leg 32 which extend in opposite directions from the member 28 and in a direction generally parallel to the traffic light. Attached to a free end of the first leg 30 is a first electromagnet 34 and attached to a free end of the second leg 32 is a second electromagnet 36. As will subsequently be described, the electromagnets 34 and 36 hold the first and second members in a first position away from the face of the traffic light as shown in FIG. 1 and in phantom in FIG. 3 while the traffic light is operating normally. As was also described above, the side members 12 and 14 are constructed of a metal material which is attracted to the electromagnets while current flow travels through the electromagnets.

Referring again to FIGS. 4 and 5, a sectional view of the resilient biasing means for biasing the shafts to rotate in a given direction is shown. With respect to the side member 12, the biasing means includes a coil spring 38 which is attached to the shaft 22 and is securely wound around the shaft 22 for a predetermined length. The coil spring 38 corresponds in length to an opening 40 in the connection between the portion 18 of the first member 12 and the rotatable shaft 22 (see FIG. 4). A free end 42 of the spring 28 is connected to the side 6 of the traffic light and biases the first member 12 to travel in a direction shown by the arrow 44 in FIG. 3. An identical connection is used for biasing the second member 14 to travel in a direction shown by the arrow 46.

As has been previously described, the purpose of the electromagnets 34 and 36 is to hold the first and second members in the position shown in FIG. 1 where they are out of the way of the face of the traffic light. Upon the interruption of the power supply to the traffic light, the current flow through the electromagnets ceases. As a result, the electromagnets lose their holding force on the first and second side members. The only forces then acting upon the side members are caused by the coiled springs which pivotally actuate the side members to rotate about directional lines 44 and 46 to a position shown in FIG. 2 whereby they cover the face of the inoperative traffic light.

Referring again to FIGS. 2 and 4, the manner in which the side members may be rewound from the second position shown in FIG. 2 to the first position shown in FIG. 1 upon resumption of electrical power to the traffic light will now be described. Specifically, an electric motor 48 is mounted atop the mounting plate 26 and is electrically connected to the power supply 2 by line 50. The power supply is also connected to the first electromagnet 34 by line 52 and to the second electromagnet 36 by line 54.

A gear 56 is mounted to a shaft extending from the electric motor 48 and is rotated by operation of the electric motor. A first linkage mechanism 58 is provided and transfers the output of the gear 56 to the shaft 22. A second linkage mechanism 60 is also provided for transferring the output of the gear 56 to the identical shaft connected to the second member. Referring again to FIG. 4, a more detailed explanation of the first linkage mechanism 58 will now be made with the understanding that the identical arrangement is also provided for the second linkage mechanism 60 for connecting to the second side member 14.

A gear 62 is secured to the mounting plate 26 so as to be meshingly engaged with the gear 56 of the electric motor. The gear 62 is mounted to a shaft 64 which extends vertically upwardly from the gear 62. Another gear 66 is mounted to the shaft 64 and is rotated by the shaft upon rotation of the gear 62. A rotating belt 68 is mounted to the gear 66 at one end and to another gear 70 at the other end. The gear 70 is mounted to an end of the shaft 22 at connection 72 and transfers the rotary output of the electric motor to the shaft. Activation of the motor for a predetermined period of time thus causes the shaft at the opposite sides of the traffic light to rotate the members. A switch, which is not shown and is commonly known in the art, can be positioned between the rotating members and the sides of the traffic signal and can be engaged to shut off the electric motor once the members have been sufficiently rotated. A timer circuit can alternatively be used to regulate the duration in which the electric motor is activated.

Figure 6:
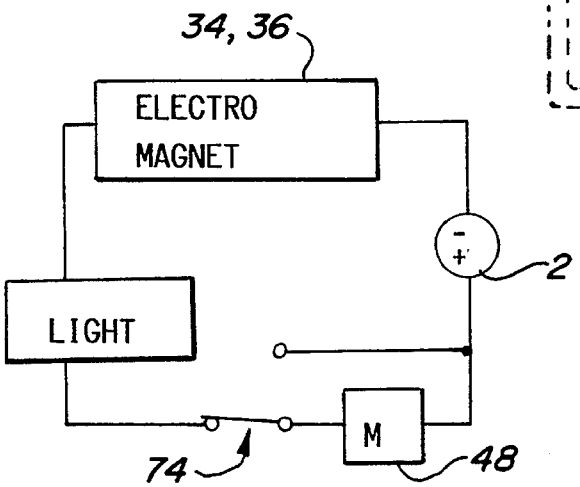
FIG. 6 is schemative view of the electrical connection between the rewinding components of the apparatus of the present invention.

Referring to FIG. 6, shown is a schematic of a closed circuit of the electrical connections for enabling the side members to be retracted. In operation, once power has been restored to the traffic light, it is desirable to rewind the side members 12 and 14 from the covering position shown in FIG. 2 to the reset position as shown in FIG. 1. A switch 74 is closed upon resumption of power to the traffic light and results in the electric motor 48 being activated for a predetermined period of time. The electric motor rotates the linkage mechanisms 58 and 60 to rewind the side members 12 and 14 against the biasing forces of the coil springs. The side members are thus withdrawn to the position shown in FIG. 1 where they are once again in contact with the electromagnets 34 and 36. The resumption of current flow to the electromagnets, as seen by lines 52 and 54 of FIG. 1, will enable the electromagnets to magnetically hold the side members against the biasing forces of the coil springs. In the event of a subsequent failure of power to the traffic light, the electromagnets will again release the side members to pivot according to the biasing forces of the coil springs.

As can be seen from the above description, the present invention provides a novel apparatus for covering the face of an inoperative traffic light with a warning sign. Further embodiments will become apparent to those skilled in the art. Specifically, the side members may be actuated from the top and bottom surfaces of the traffic light, rather than from the opposite side, provided that appropriately configured members are used. Also, the respective traffic lights in a four-way intersection can be spaced relative to each other an adequate distance to permit each to employ the apparatus of the present invention. Also, when a single mounting bracket is used for the four-way lights, an apparatus can be separately installed on each of the traffic lights.

I claim:

1. An apparatus for covering a face of a traffic signal with a warning sign in response to a power failure to the traffic signal, said apparatus comprising:

a first member mounted to one side of the traffic signal;

a second member mounted to another side of the traffic signal;

means for engaging said first member and said second member from a first position away from the face of the traffic signal to a second position covering the face of the traffic signal in response to power failure to the traffic signal, said means for engaging comprises means for pivoting said first member and said second member to cover the face of the traffic signal, said means for pivoting comprises a first rotating shaft securing said first member along said one side of the traffic signal and a second parallel rotating shaft securing said second member along said other side of the traffic signal; and a first electromagnet for securing said first member and a second electromagnet for securing said second member in said first position.

2. The apparatus as described in claim 1, further comprising a first electromagnet for securing said first member and a second electromagnet for securing said second member in said first position.

3. The apparatus as described in claim 2, wherein said means for engaging comprises means for pivoting said first member and said second member to cover the face of the traffic signal, said means for pivoting comprises a first rotating shaft mounted to said first member and a second rotating shaft mounted to said second member.

4. The apparatus as described in claim 3, further comprising a first coil spring mounted around said first rotating shaft and a second coil spring mounted around said second rotating shaft, said coil springs connecting to the traffic signal and biasing said shafts to rotate said first member and said second member from said first position to said second position.

5. The apparatus as described in claim 1, said first member and said second member each further comprising a flat surface portion and a perpendicularly extending end portion connected to said rotating shafts.

6. The apparatus as described in claim 3, further comprising a first mounting plate and a second mounting plate secured to the traffic signal at upper and lower ends thereof, said rotating shafts being mounted between said mounting plates.

7. The apparatus as described in claim 1, further comprising means for rewinding said first member and said second member from said second position to said first position following the resumption of power to the traffic signal.

8. The apparatus as described in claim 1, further comprising a warning symbol upon exterior surfaces of said first member and said second member which becomes visible over the traffic signal when said members are in said second position.

9. An apparatus for covering a face of a traffic signal with a warning sign in response to a power failure to the traffic signal, said apparatus comprising:

a first member mounted to one side of the traffic signal;

a second member mounted to another side of the traffic signal;

means for engaging said first member and said second member from a first position away from the face of the traffic signal to a second position covering the face of the traffic signal in response to power failure to the traffic signal, said means for engaging comprising means for pivoting said first member and said second member to cover the face of the traffic signal, said means for pivoting comprises a first rotating shaft mounted to said first member and a second rotating shaft mounted to said second member;

a first coil spring mounted around said first rotating shaft and a second coil spring mounted around said second rotating shaft, said coil springs connecting to the traffic signal and biasing said shafts to rotate said first member and said second member from said first position to said second position; and a first electromagnet for securing said first member and a second electromagnet for securing said second member in said first position.

10. An apparatus for covering a face of a traffic signal with a warning sign in response to a power failure to the traffic signal, said apparatus comprising:

a first member mounted to one side of the traffic signal;

a second member mounted to another side of the traffic signal;

means for engaging said first member and said second member from a first position away from the face of the traffic signal to a second position covering the face of the traffic signal in response to power failure to the traffic signal, said means for engaging comprises means for pivoting said first member and said second member to cover the face of the traffic signal, said means for pivoting comprises a first rotating shaft mounted to said first member and a second rotating shaft mounted to said second member;

a first mounting plate and a second mounting plate secured to the traffic signal at upper and lower ends thereof, said rotating shafts being mounted between said mounting plates; and a first electromagnet for securing said first member and a second electromagnet for securing said second member in said first position.

11. The apparatus as described in claim 10, further comprising a member extending from said mounting plate at the upper end of the traffic signal, said member having a first leg to which is attached said first electromagnet, said member further having a second leg to which is attached said second electromagnet.

12. The apparatus as described in claim 10, wherein said means for rewinding comprises an electric motor supported upon first mounting plate at the upper end of the traffic signal.

13. The apparatus as described in claim 9, further comprising a gear rotated by said electric motor, said gear engaging a first linkage mechanism to rotate said first shaft and a second linkage mechanism to rotate said second shaft.

* * * * *